US009763484B2

(12) United States Patent
Conolly et al.

(10) Patent No.: US 9,763,484 B2
(45) **Date of Patent: *Sep. 19, 2017**

(54) WATERSPORT HIKING SUPPORT SYSTEM

(71) Applicants: Brian John Conolly, Northwood (AU); Bartosz Milczarczyk, Lane Cove (AU)

(72) Inventors: Brian John Conolly, Northwood (AU); Bartosz Milczarczyk, Lane Cove (AU)

(73) Assignee: Zhik Pty Ltd, Artarmon, New South (AU)

( * ) Notice: Subject to any disclaimer, the term of this patent is extended or adjusted under 35 U.S.C. 154(b) by 0 days.

This patent is subject to a terminal disclaimer.

(21) Appl. No.: 14/723,158

(22) Filed: May 27, 2015

(65) Prior Publication Data

US 2015/0257461 A1 Sep. 17, 2015

Related U.S. Application Data

(63) Continuation-in-part of application No. 12/180,069, filed on Jul. 25, 2008, now Pat. No. 9,101,815.

(30) Foreign Application Priority Data

Jul. 27, 2007 (AU) ..... 2007904069
May 27, 2014 (AU) ..... 2014902006

(51) Int. Cl.
*A41D 13/015* (2006.01)
*A41D 13/00* (2006.01)
(Continued)

(52) U.S. Cl.
CPC ..... *A41D 13/0543* (2013.01); *A41D 13/0015* (2013.01); *A41D 13/015* (2013.01);
(Continued)

(58) Field of Classification Search
CPC .... A41D 13/0015; A41D 1/08; A41D 13/065; A41D 2400/38; A41D 13/0575; A41D 13/02; A41D 13/05; A41D 13/0568; A41D 1/06; A41D 2400/24; A41D 31/0044; A41D 7/00; A41D 13/0012; A41D 13/0506;
(Continued)

(56) References Cited

U.S. PATENT DOCUMENTS 891,977 A * 6/1908 Bloch ..... A41D 1/06 2/227
4,325,148 A * 4/1982 Livernois ..... A63B 71/12 2/22
(Continued)

FOREIGN PATENT DOCUMENTS

GB 2431563 A 5/2007

*Primary Examiner* — Bobby Muromoto, Jr.
(74) *Attorney, Agent, or Firm* — Whitmyer IP Group LLC

(57) ABSTRACT

A device that provides support for sailors while hiking from a sailing vessel is disclosed. The device is a pair of sleeves tailored with pockets under each thigh that allow for supporting pads to be inserted in various combinations. The pads are ergonomically designed and can be designed with internal fiberglass battens, or molded plastic, and optionally in shapes that help apply torque to the boat dynamics. The sleeves are designed with one way stretch to optimize grip to the leg, and constructed in a choice of composite materials to aid durability and comfort.

28 Claims, 7 Drawing Sheets

(51) Int. Cl.
*A41D 13/05* (2006.01)
*A63B 71/12* (2006.01)

(52) U.S. Cl.
CPC ..... *A63B 71/1225* (2013.01); *A41D 2300/20* (2013.01); *A41D 2600/10* (2013.01); *A63B 2071/125* (2013.01); *A63B 2071/1233* (2013.01); *A63B 2071/1241* (2013.01); *A63B 2209/10* (2013.01)

(58) Field of Classification Search
CPC ..... A63B 2071/1233; A63B 71/12; A63B 2071/1241; A63B 2071/125; A63B 2071/1258; A63B 21/0552; A63B 21/4025; A63B 71/081; A63B 21/065; A63B 69/18; A63B 71/1225
USPC .... 14/455, 456, 22, 23, 24, 61, 62, 79, 214, 14/215, 227, 231, 233, 239, 240, 241, 14/309, 311–322, 248, 249, 250, 251, 14/252, 267, 268, 270, 911, 919, 920
See application file for complete search history.

(56) References Cited

U.S. PATENT DOCUMENTS 4,450,832 A * 5/1984 Waddell ..... A61F 5/0104 2/22
4,733,656 A * 3/1988 Marquette ..... A61F 5/0123 2/22
4,793,333 A * 12/1988 Marquette ..... A61F 5/0123 2/22
5,161,257 A * 11/1992 Arensdorf ..... A41D 13/0575 2/22
6,186,970 B1 * 2/2001 Fujii ..... A41D 13/0015 2/22
6,243,879 B1 * 6/2001 Lyden ..... A41B 9/02 2/227
6,745,406 B2 * 6/2004 Ruane ..... A41D 13/0506 2/23
7,516,498 B2 * 4/2009 Torry ..... A41D 1/08 2/69
7,784,116 B2 * 8/2010 Gallo ..... A41D 31/0044 2/267
9,101,815 B2 * 8/2015 Conolly ..... A63B 71/12
2001/0014981 A1 * 8/2001 Fairhurst ..... A41D 7/00 2/69
2002/0178483 A1 * 12/2002 Beland ..... A41D 1/08 2/22
2003/0092544 A1 * 5/2003 Reed ..... A63B 21/0603 482/105
2004/0107479 A1 * 6/2004 Dicker ..... A41D 13/0015 2/227
2005/0054759 A1 * 3/2005 Smith ..... C07C 67/14 524/284
2006/0026732 A1 * 2/2006 Nordt ..... A41D 13/05 2/69
2006/0130215 A1 * 6/2006 Torry ..... A41D 1/08 2/227
2007/0074430 A1 * 4/2007 Coomer ..... A43B 7/141 36/145
2007/0204481 A1 * 9/2007 Conolly ..... B63H 9/1007 36/8.1
2008/0022431 A1 * 1/2008 Gallo ..... A41D 31/0044 2/69
2008/0120757 A1 * 5/2008 Nakazawa ..... A41D 13/0015 2/22
2008/0125842 A1 * 5/2008 Petitt ..... A41D 13/0012 607/108

* cited by examiner

WATERSPORT HIKING SUPPORT SYSTEM

FIELD OF THE INVENTION

The invention generally relates to the field of sportswear products. More specifically, the invention relates to combining a novel hiking support system with sports clothing, such as a wetsuit, to help reduce muscle fatigue in situations such as hiking from the gunnels of a sailing vessel.

BACKGROUND OF THE INVENTION

Any discussion of the prior art throughout the specification should in no way be considered as an admission that such prior art is widely known or forms part of common general knowledge in the field.

Hiking support systems have been applied to wetsuits for dinghy sailing for some time, typically for hiking from a sailing dinghy like that shown in FIG. 1. These systems typically comprise a set of fibreglass battens that are sewn directly into the wetsuit behind the thigh portion, or alternatively pads that are inserted into pockets or otherwise directly connected to the thigh portions of the wetsuit.

Such systems have a variety of functional problems because the hiking support pads or battens are connected directly to a wetsuit. Also, in such systems, the wetsuit is commonly constructed of a material that will stretch when wet or with repetitive use, which in turn causes the hiking support to fail to hold the battens or pads firmly in place around the leg. To compensate for these structural problems, these wetsuits are commonly designed to be very tight fitting on initial purchase. As durability is also a problem when the hiking support system is connected directly with the wetsuit, the wetsuit is commonly made with thick abrasive resistant material, which in turn makes them heavier and less comfortable to wear.

SUMMARY OF THE INVENTION

It is an object of the present invention to provide an improved hiking support system.

In accordance with a first aspect of the present invention there is provided a hiking support systems comprising:

- a first sleeve portion having a pocket for receiving at least one resilient pad of predetermined stiffness;
- wherein the sleeve portion, having the pad inserted, is adapted to be worn by a user for providing support to the user while hiking.

Preferably, the sleeve portion comprises a substantially planar panel, wherein opposite ends of the panel are releasably fastenable together to define the sleeve. The sleeve, having the pad inserted, is preferably adapted to be worn by a user beneath a wetsuit. More preferably, the system is manufactured with the pad fixedly inserted in the pocket of the sleeve portion.

The sleeve portion is preferably adapted to include a stretch gradient for restricting movement of the sleeve portion during use. Preferably, the stretch gradient is included by a printed pattern on a surface of the sleeve portion. Alternatively, the sleeve portion includes a nylon layer, wherein the nylon layer can be manufactured to incorporate the stretch gradient in its weave. More preferably, the sleeve portion is further adapted to substantially only stretch in one-direction.

Preferably, the said printed pattern provides a stretch gradient by restricting the amount of stretch of the sleeve in areas where the print is bonded to the sleeve material. More preferably said printed pattern forms an internal band or series of internal bands of gripping material for griping the leg of the user and reducing the possibility of the system moving down the leg during use.

In accordance with a second aspect of the present invention there is provided a method of providing improved hiking capabilities, the method including the step of:

- providing a hiking system as previously described and
- providing pads of various stiffness which can be inserted into the pockets in different combinations depending on sailing conditions.

In accordance with a third aspect of the present invention there is provided a hiking support systems comprising:

- a first substantially planar panel adapted to releasably fasten opposite ends of the panel together to define a first sleeve portion; the panel including a pocket for receiving at least one resilient pad of predetermined stiffness;
- wherein the sleeve portion, having the pad inserted, is adapted to be worn by a user for providing support to the user while hiking.

Preferably, the panel is adapted for wrapping around the thigh of the user and fastening in a fitted operative sleeved configuration. More preferably, the panel is adapted to include a stretch gradient for restricting movement of the sleeve portion during use. Preferably, the said printed pattern provides a stretch gradient by restricting the amount of stretch of the sleeve in areas where the print is bonded to the sleeve material. More preferably said printed pattern forms an internal band or series of internal bands of gripping material for griping the leg of the user and reducing the possibility of the system moving down the leg during use. Preferably, the system is manufactured with the pad fixedly inserted in the pocket. In one embodiment the fastening is preferably achieved using a Velcro closure.

In accordance with a further aspect of the present invention there is provided a method of providing improved hiking capabilities, the method including the step of: providing a hiking system with pads of various stiffness which can be inserted in different combinations depending on sailing conditions into a pair of durable pockets sewn into thigh sleeves.

In accordance with a further aspect of the present invention, in preferred embodiments, there is provided an interchangeable pairs of pads, made of composite material, housed in a pocket behind each thigh in a separate thigh sleeve worn under, and separate to, an outer suit. There is one thigh sleeve for each leg to house the hiking support. The sailor then wears a more conventional wetsuit over the top of these thigh sleeves. The removable pad is designed to produce a seamless surface that will be both stiff in the vertical direction and yet flexible in the horizontal direction. The pads can be varied in all dimensions, including flexibility and in depth depending on the users requirements and weather conditions. Pads of different types can also be joined together (for example using Velcro) and used in various combinations together in the same pocket, for different conditions or user requirements. As shown in the accompanying drawings, the application of Velcro is preferably the centre of the pad such that they can combine and maintain flexibility around the leg. The pads can be easily removed entirely, for example if a sailor sails in light winds where the extra weight of the pads is unnecessary and extra flexibility for the sailor is an advantage. In a preferred embodiment to opening of said pocket is stretchable to allow the pad(s) to be inserted whilst also fixing said pad(s) in place during use. In another preferred embodiment, said pad pocket features printed or bonded areas of reduced stretchable material around the edges of said pocket to provide improved connection between sleeve and pad.

In preferred embodiments, the thigh sleeve and pad pocket design is made of a combination of soft, hard wearing, and gripping materials. Optionally the thigh sleeve and pad pocket design can include a specific horizontal or vertical one way stretch direction, in order to optimise fitting and to restrict the thigh sleeves from falling or moving down the leg during use.

In one embodiment the thigh sleeve and pad pocket material is made of nylon laminated neoprene. The nylon laminated on the side of the neoprene that touches the skin can be made soft and comfortable, and optionally chosen to be 'grippy' when wet. The material laminated to the outer panel lining, and optionally to the internal lining to the pocket, can be made of a more abrasive resistant nylon. The laminates are optionally chosen to stretch in a one-way vertical direction, so as to help reduce the possibility that the sleeve will fall down the leg during use. The user can place the thigh sleeves with pads inserted onto their leg at their own personal custom position. They then wear an outer wetsuit, which is preferably designed to have good abrasive resistance around the areas of the thigh sleeve. This outer wetsuit is not connected to the thigh sleeves, and just wraps over the top and is not critical to the function of the hiking suit. This outer wetsuit can then be made of lighter and stretchier materials than other hiking support systems, which can increase the comfort for a user.

In accordance with a further aspect of the present invention there is provided a method of providing improved hiking capabilities, the method including the step of:

providing a hiking system as previously described and providing pads of fixed stiffness which are fixed to said sleeve whereby said pads are attached by stitching or gluing to said sleeve.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION OF THE INVENTION

Figure 1:
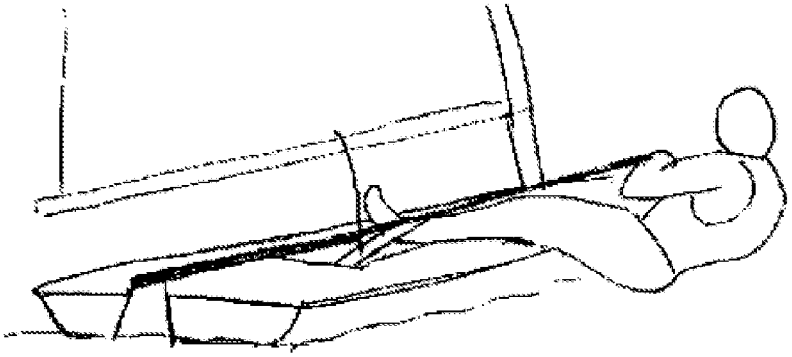
FIG. 1 illustrates an example of hiking from a sailing dinghy.
Figure 2:
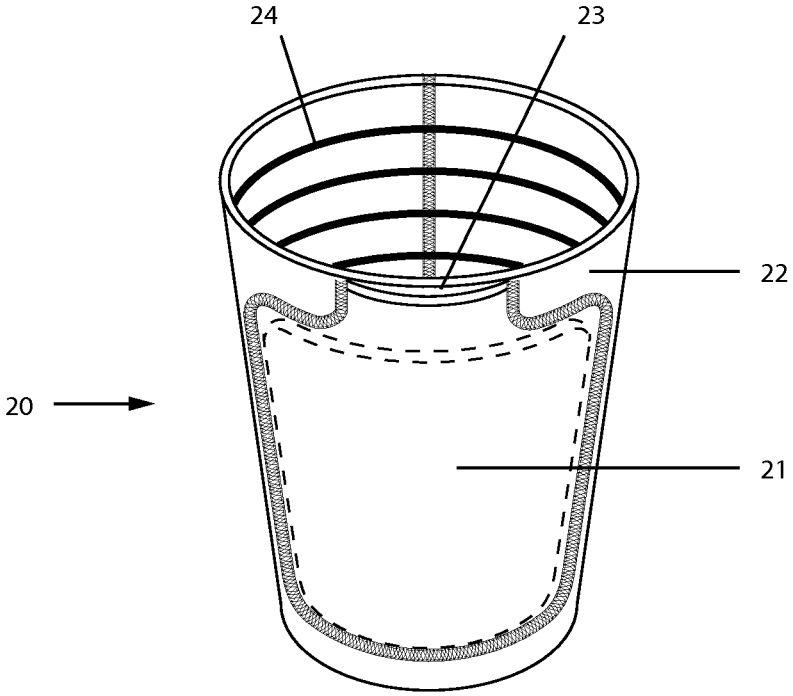
FIG. 2 illustrates an example thigh sleeve and pad pocket construction.

Referring to FIG. 2, an example thigh sleeve 20 with pad pocket is shown. The thigh sleeve is constructed of a composite of various nylons laminated to neoprene. A pocket panel 21 having an opening 23 is sewn to sleeve panel 22. Pocket opening 23 is preferably stretchable to allow the pad to be inserted whilst also fixing said pad in place during use.

Optionally a gripping material can be included on the inside of the sleeve. Said gripping material is preferably printed or bonded to said sleeve in a substantially continuous band or series of bands. Sleeve panel 22 and pocket panel 21 is designed to have one way stretch in the vertical direction to help stop the thigh sleeve from falling down the leg.

The nylon laminated to the outside of the sleeve panel 22 is preferably made to a high abrasive resistant grade. The nylon laminated the pocket panel 21 is also preferably a high abrasive resistant grade. The nylons laminated to the inside of sleeve panel 21 are preferably softer grades for comfort. All panels 21 and 22 are preferably 1 mm thick neoprene.

Figure 3:
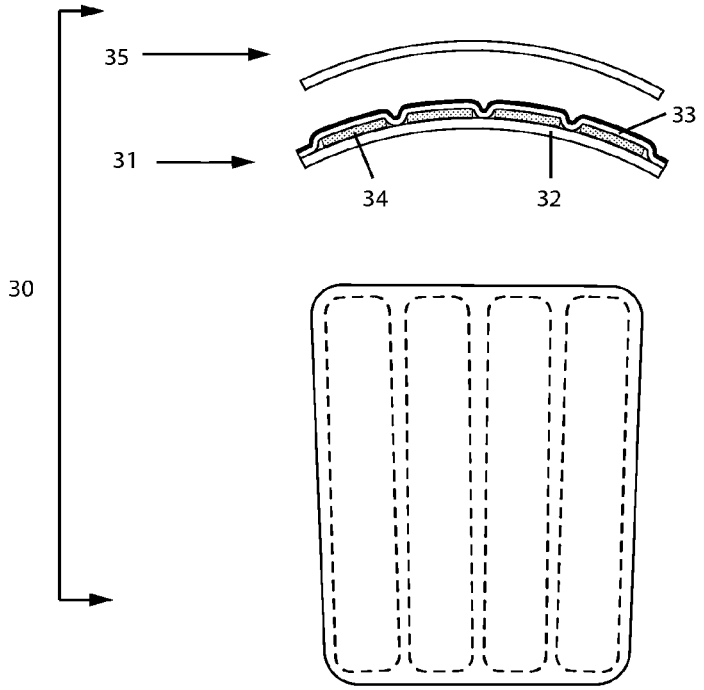
FIG. 3 illustrates an example pad combination with batten inserts front view and top view.

FIG. 3 shows an example pad combination 30. A battened pad 31 is made with three or more fibreglass battens 34. These battens are cut, and sharp edges ground. An inner laminate 32 comprising of neoprene foam or Ethylene vinyl acetate (EVA) or other foam is provided to give comfort to the user whilst an outer laminate 33 comprising a harder compound of neoprene foam or Ethylene vinyl acetate (EVA) or other foam is provided to give protection to the deck of the vessel. Thickness of said inner and outer laminates is preferably between 1 mm and 6 mm and said laminated preferably have a layer or nylon textile laminated to one or more sides of each layer to provide extra durability.

The battened pad 31 is laminated together and designed to taper from top to bottom, having curved edges, and taper at the top to match ergonomics of hiking. Soft nylon laminated neoprene sheeting material, with sufficient flexibility and durability, is required so that the whole pad will mould around a user's leg comfortably. Battened pad is preferably moulded or laminated in a curved shape as to better conform to the wearers leg.

A second pad insert 35 having no internal battens is shown. This pad is designed to simply add extra height and padding. This "extension pad" is designed to be added into sleeve pad pocket with main batten pad. Hook and loop Velcro may be provided at the centre of the pad to fix together with battened pad with the centre position of the Velcro allowing the two pads to flex around the leg without increased stiffness. In one preferred embodiment, this extension pad can be made out of Ethylene vinyl acetate foam and is 5 mm thick.

Figure 4:
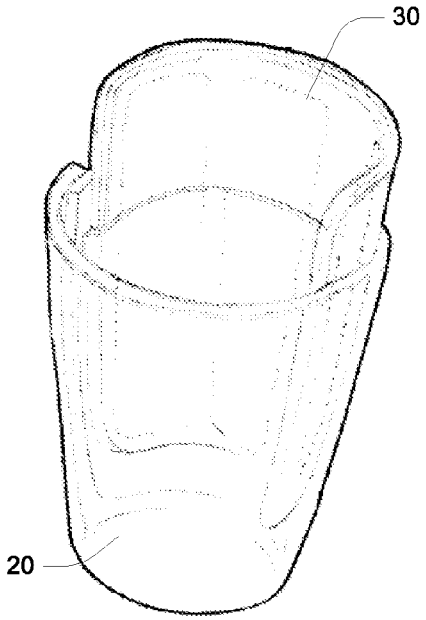
FIG. 4 illustrates the insertion of a pad combination into a thigh sleeve with pocket.

Referring to FIG. 4, the combined pads 30 are shown being inserted into the thigh sleeve 20. It will be appreciated that FIG. 4 does not show the pad fully inserted within a respective pocket. Preferably, the pads 30 (in this example comprising pad 31 and/or pad 32 as best shown in FIG. 3) when fully inserted, are shorter in the vertical direction to the thigh sleeve pocket. Preferably extra material at the top and the bottom of the thigh sleeve and pad pocket helps to keep this hiking support system grip to the leg. Optionally just the single battened pad 31 or the single extension pad 32 is inserted into the thigh sleeve, depending on the hiking support required.

The pads can be optionally pre-curved in shape and constructed of moulded plastic or other synthetic material. Due to the curved shape of the pad it will be naturally stiff in the direction up and down the thigh as required for hiking support, yet flexible around the leg for comfort.

Figure 5:
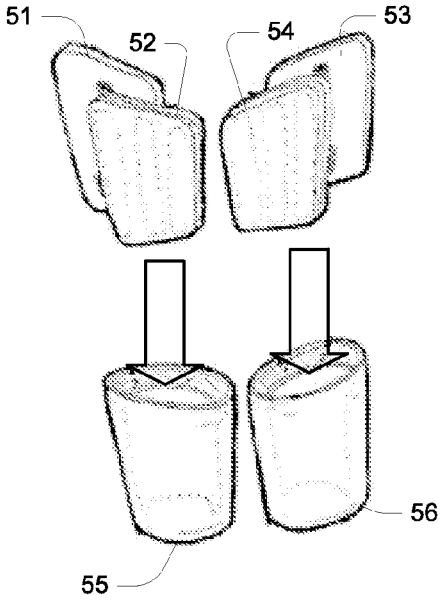
FIG. 5 Illustrates a pair of pad combinations going into left and right thigh sleeves.
Figure 6:
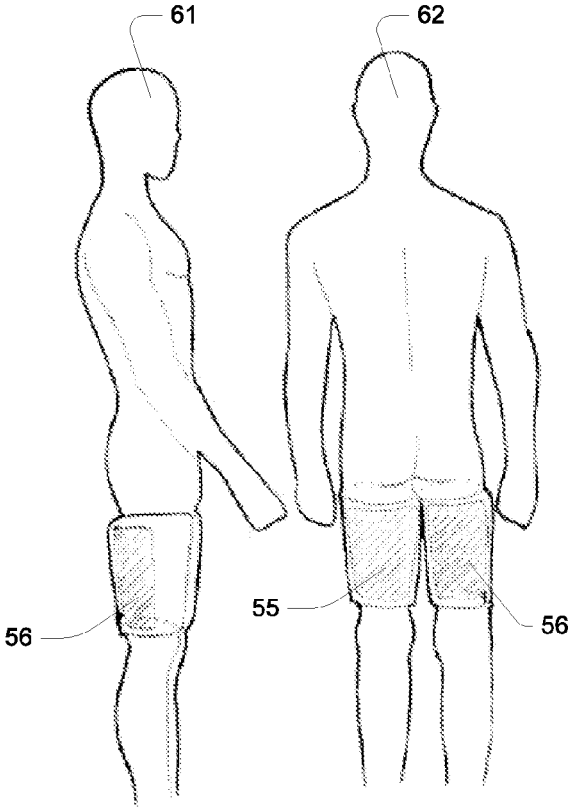
FIG. 6 Illustrates side and rear view of thigh sleeve and pad pocket placed on body.

FIG. 5 shown an example complete hiking support system comprising pads 51, 52, 53 and 54 and sleeves 55 and 56. The right thigh sleeve 56 and left thigh sleeve 55 with respective extension pads 51 and 53 and battened pads 52 and 54. These are placed on the thighs of a user as shown in FIG. 6, with side view and rear view.

Figure 7:
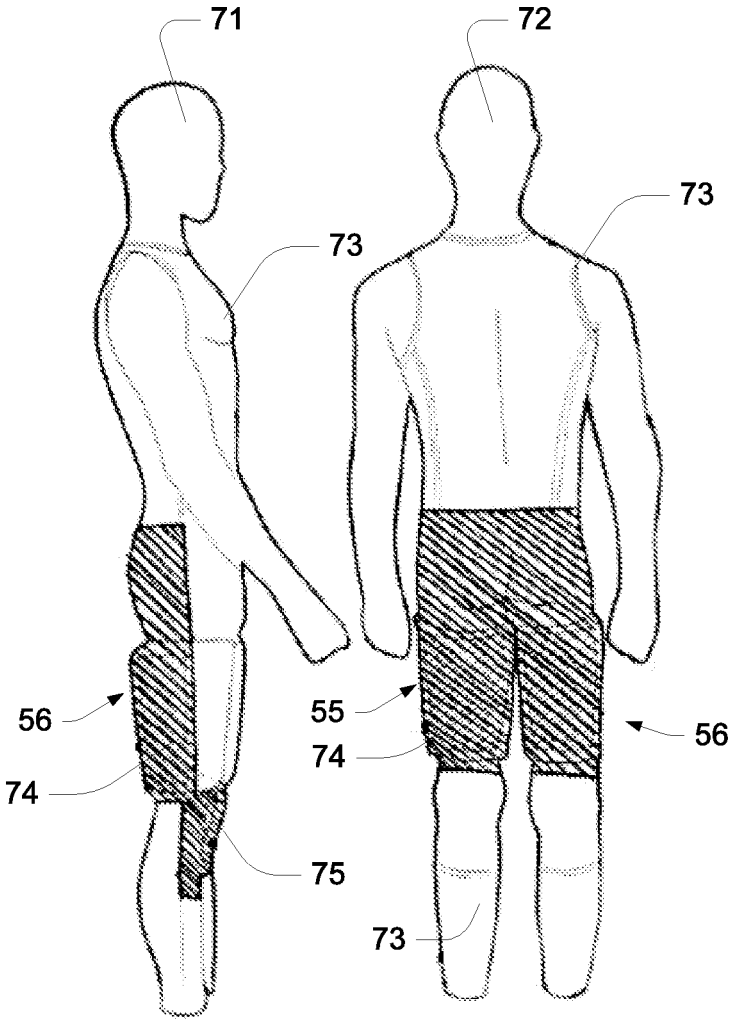
FIG. 7 Illustrates side and rear views of outer suit over high sleeve and pad pockets on body.

FIG. 7 shows an example wetsuit 73 can be worn over the top of the thigh sleeves. Abrasive resistant material is preferably applied in area 74. Knee pads 75 are also preferably made of an abrasive resistant material.

Figure 8:
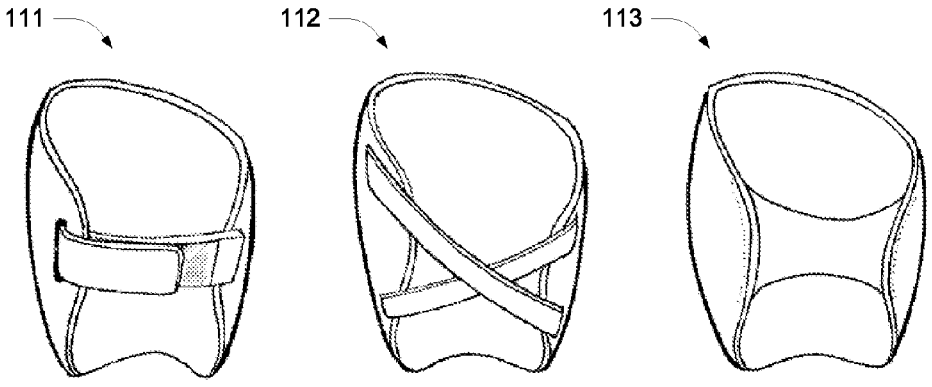
FIG. 8 Illustrates variations of alternative strapping for pad designs.

Referring to FIG. 8, pads can be optionally made to strap to the leg in a variety of ways, with three applications of a flexible banding system (111, 112 and 113). This banding could be made of neoprene, elastic or other similar material joined to the pre-curved pads.

Figure 9:
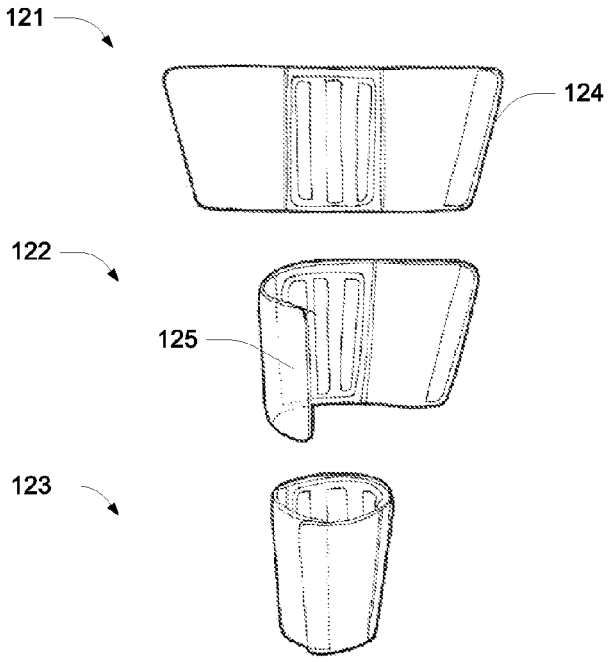
FIG. 9 Illustrates how a flat piece can wrap and close to form a sleeve, which can custom fit to a user's thigh.

FIG. 9 shows that a relatively flat panel 121 can wrap 122 and close 123 to form a sleeve. This sleeve can be fastened for conforming to a custom fit of a user's thigh. The material choice for this sleeve that wraps on with the pad pocket can similar to the construction of FIG. 4.

The pads can be preinstalled at manufacture by sewing them directly into the material. By way of example, an outer laminate 125 of the panel is a material that connects like Velcro loops to Velcro hooks 124 to provide a releasable fastening. The shape of the wrap and surface area of the Velcro hooks can be varied depending on the design choice. For example, some systems can wrap with one Velcro Hook tab, other systems could use two or three separate areas.

Figure 10A:
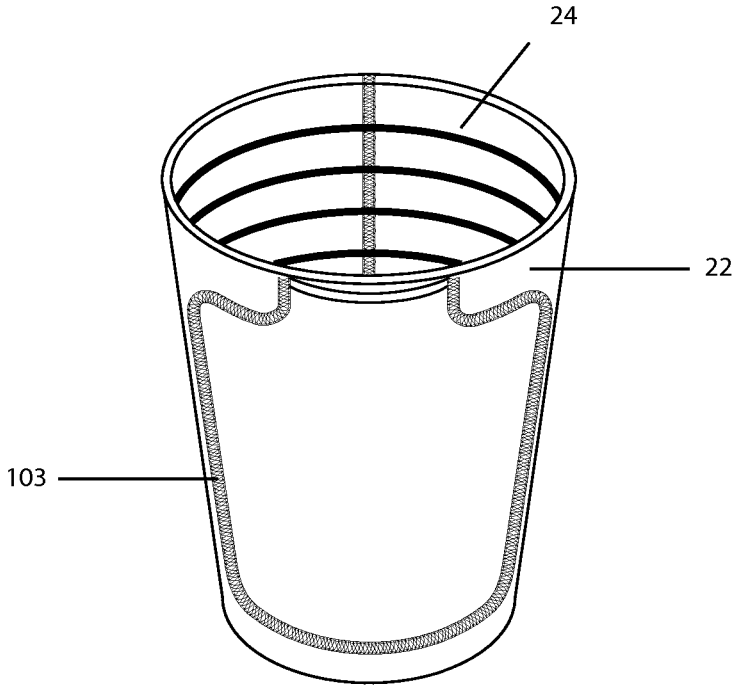
FIG. 10A Illustrates a sleeve with gradient lines to define a stretch gradient.
Figure 10B:
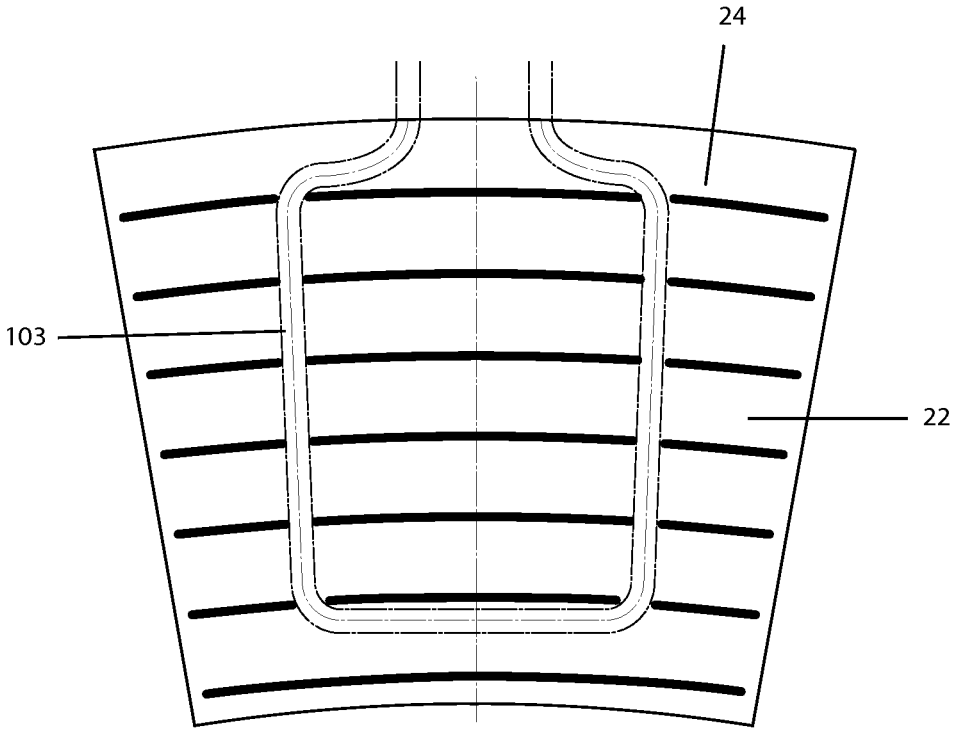
FIG. 10B Illustrates an inner view of a sleeve panel with gradient lines to define a stretch gradient.

FIGS. 10A & 10B show a sleeve panel 22 with gradient lines 24 that describe a stretch gradient. Said gradient lines have substantially reduced stretch compared to the sleeve material and comprise an area of high grip material. The reduced stretch of said gradient lines thereby constricts the areas of high grip material into the wears leg to increase friction and prevent to movement of the sleeve when in use.

It will be appreciated that there are various ways to construct a sleeve that approximates this stretch gradient and high grip areas. In a preferred embodiment said stretch gradient is provided by means of printed or bonded bands comprised of a silicone or other high grip material. Said bands are preferably between 1 mm and 10 mm wide and spaced in a regular or irregular pattern inside the sleeve. In one embodiment said bands are discontinuous to allow for ease of stitching of pad pocket along stitching line 103. In another preferred embodiment, the bands are formed to maximize the number of edges and corners (such as in a zig-zag shape) which come into contact with the user's leg, thereby increasing the sleeve's ability to resist movement.

In other configurations for providing a suitable stretch gradient, a stretch pattern can be designed and printed onto the surface of a panel (or sleeve), such that in use the sleeve is tighter in various areas. This pattern can also be designed to more closely follow the ideal muscle compression for optimised hiking comfort, recovery and blood flow. The pattern can be printed on an interior or exterior surface of the panel (or sleeve).

Figure 11A:
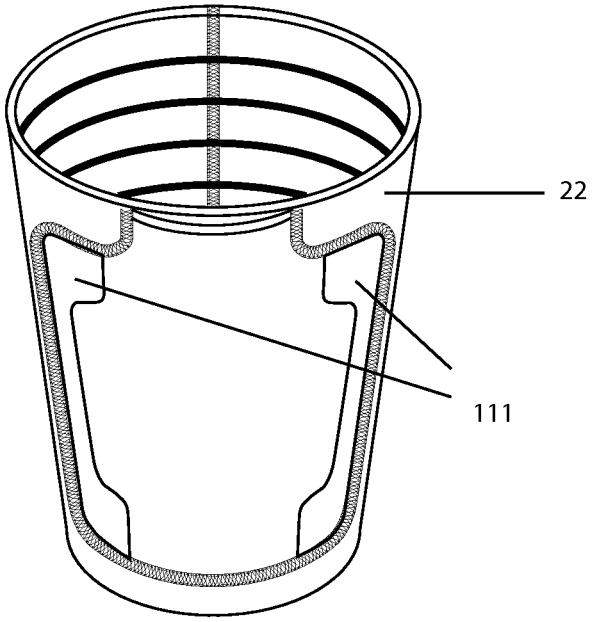
FIG. 11A Illustrates a sleeve with printed gradient areas to define locate inserted pad.
Figure 11B:
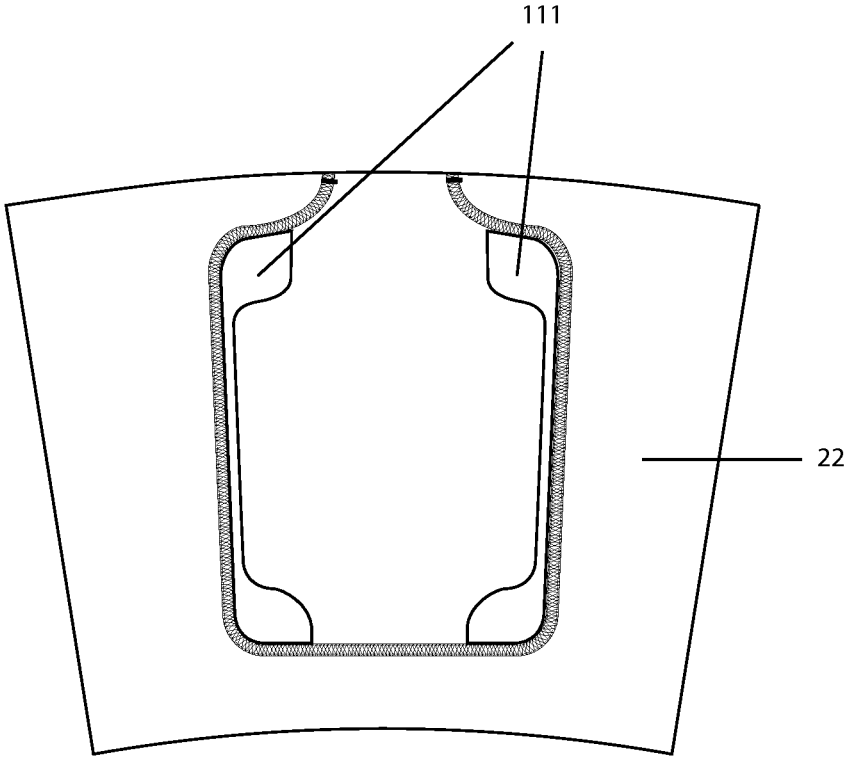
FIG. 11B Illustrates an outer view of a sleeve with printed gradient areas to define locate inserted pad.

FIGS. 11A & 11B show a sleeve panel 22 with stretch gradient areas 111 provided on pad pocket 21 whereby stretch gradient areas are a printed or bonded material with reduced stretch configured to provide better location of inserted pad thereby reducing movement of said pad during use.

The panel (or sleeve) can be wrapped and used with a Velcro closure or similar to provide a custom fit for the user. The sleeve can also be wrapped with Velcro tabs to provide closure and or support.

For easier manufacture and/or user convenience, the pads can be optionally preinstalled by sewing them into the panel (or sleeve). The pads may also be glued or laminated to the sleeve. Further, a pair of sleeves can be attached to nylon briefs.

A sleeve can also work as a compression garment to reduce fatigue and enhance recovery of the working thigh muscles. The sleeve can be designed with optimum compression for hiking.

According with an embodiment, a hiking support system comprises a first substantially planar panel including a layer of lateral stretch Nylon, and Neoprene. Velcro strips are provided at opposite ends of the panel for releasably fastening these ends together to define a sleeve portion. The panel includes a pocket for retaining at least one resilient pad of predetermined stiffness. The pad is fixedly inserted in the pocket, and is comprised of Ethlene Vinyl Acetate (EVA) closed cell foam and high grade strength fibreglass battens. The sleeve, having the pad inserted, is adapted to be worn by a user for providing support to the user while hiking. The panel is adapted to be wrapped around the thigh of the user and fastened in a fitted operative sleeved configuration. Fastening is achieved using a Velcro closure. The panel has a stretch gradient for restricting movement of the sleeve portion during use.

By way of example only, the system can be used in a number of sailing environments, including:

- Hiking Pants for Small Boat Dinghy Sailing. In this example, a hiking system works well for sailors of dinghy classes, such as the Olympic Classes Laser or Finn as well as a large range of other classes of boat.
- Hiking Pants for Sportsboat Yachting. In this example, versions of a hiking system can be designed for sportsboat yachting. These systems typically have hiking pads and suit in different dimensions and materials.
- Hiking Shorts for Yachting. In this example a short version of the hiking system, with no straps and a thinner padded insert design may be used for yachting purposes, where the hiking is less strenuous.

As used herein, unless otherwise specified the use of the ordinal adjectives 'first', 'second', 'third', etc., to describe a common object, merely indicate that different instances of like objects are being referred to, and are not intended to imply that the objects so described must be in a given sequence, either temporally, spatially, in ranking, or in any other manner.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to."

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Although the invention has been described with reference to specific examples, it will be appreciated by those skilled in the art that the invention may be embodied in many other forms.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. A hiking support system, comprising:

a first sleeve portion having an interior surface and a pocket;

a polymeric or silicone material disposed on a portion of the interior surface of the first sleeve portion;

a pad adapted to be inserted into said pocket;

wherein the polymeric or silicone material has a higher coefficient of friction than the first sleeve portion; and wherein the polymeric or silicone material is printed or bonded to the interior surface of the first sleeve portion in a series of bands.

2. A system as claimed in claim 1 wherein said sleeve portion includes a stretch gradient for restricting stretch in defined areas of said sleeve.

3. A system as claimed in claim 2 wherein said stretch gradient is provided by printing or bonding a regular or irregular pattern.

4. A system as claimed in claim 3 whereby said pattern is provided in bands, whereby said pattern also provides a high friction surface.

5. A system as claimed in claim 2, wherein said sleeve portion includes a nylon layer, wherein said nylon layer is manufactured to incorporate said stretch gradient in its weave.

6. A system as claimed in claim 1, wherein said sleeve portion is further adapted to stretch substantially more in a first direction than in a direction orthogonal to the first direction.

7. A system as claimed in claim 1, wherein said sleeve portion comprises a substantially planar panel, wherein opposite ends of said panel are releasably fastenable together to define said sleeve.

8. A system as claimed in claim 1, wherein said sleeve portion, having said pad inserted, is adapted to be worn by a user beneath a wetsuit for providing support to the user while hiking.

9. A system as claimed in claim 1, wherein the pad is fixedly inserted in said pocket of said sleeve portion.

10. A system as claimed in claim 1, wherein said sleeve portion is further adapted as a compression garment for reducing fatigue and enhancing recovery of a users' thigh muscles.

11. A system as claimed in claim 1, further comprising:

a second sleeve portion having a pocket for receiving a second pad, and having said second pad inserted;

wherein said first and second sleeve portion are attached to briefs such that said briefs is worn by a user beneath a wetsuit.

12. A system as claimed in claim 1 wherein said pad is constructed from any one or more of the set comprising Ethylene Vinyl Acetate (EVA) sheeting, nylon laminated foam and neoprene, which is glued together over fibreglass battens.

13. A system as claimed in claim 1 wherein two or more pads are inserted in said pocket, wherein said pads are clipped together in their centre with a hook and loop type closure to maintain flexibility while used in combination.

14. A system as claimed in claim 1, wherein said pocket has a drain hole to substantially avoid retaining water in said pocket when in use.

15. A system as claimed in claim 1 wherein said pocket has a stretchable opening to allow the pad to be inserted whilst also fixing said pad in place during use.

16. A hiking support systems comprising:

a first substantially planar panel adapted to releasably fasten opposite ends of said panel together to define a first sleeve portion;

a high friction material disposed on a portion of an interior surface of the first sleeve portion; and said panel including a pocket for receiving a pad.

17. A system as claimed in claim 16, wherein said panel is adapted for wrapping around the thigh of a user and fastening in a fitted operative sleeved configuration.

18. A system as claimed in claim 16, wherein said system is manufactured with said pad fixedly inserted in said pocket.

19. A system as claimed in claim 16, wherein said fastening is achieved using a hook and loop type closure.

20. A system as claimed in claim 16 wherein the high friction material is a printed or bonded high friction polymeric or silicone material.

21. A system as claimed in claim 16 wherein said sleeve portion includes a stretch gradient for restricting stretch in defined areas of said sleeve.

22. A system as claimed in claim 16 wherein said stretch gradient is provided by printing or bonding a regular or irregular pattern.

23. A system as claimed in claim 16 whereby said pattern is provided in bands, whereby said pattern also provides a high friction surface.

24. A system as claimed in claim 16, wherein said sleeve portion includes a nylon layer, wherein said nylon layer is manufactured to incorporate said stretch gradient in its weave.

25. The system of claim 1, wherein said high friction material is disposed in a zig-zag pattern.

26. The system of claim 1, wherein said high friction material is disposed in an unevenly-spaced pattern.

27. The system of claim 1, wherein said high friction material is disposed in a discontinuous pattern.

28. The system of claim 1, wherein the bands are between about 1 mm and about 10 mm wide.

* * * * *